United States Patent [19]

Auran et al.

[11] Patent Number: 4,810,284

[45] Date of Patent: Mar. 7, 1989

[54] METHOD AND APPARATUS FOR PRODUCING METAL POWDER

[75] Inventors: Lars Auran; Ivar O. Rød; Ole Tangen; Alf E. Gravem, all of Sunndalsøra, Norway

[73] Assignee: Norsk Hydro a.s., Oslo, Norway

[21] Appl. No.: 151,092

[22] Filed: Feb. 1, 1988

[51] Int. Cl.[4] ..... B22F 9/08

[52] U.S. Cl. ..... 75/0.5 C; 425/7

[58] Field of Search ..... 75/0.5 C; 425/7

[56] References Cited

U.S. PATENT DOCUMENTS 3,551,532 12/1970 Laird ..... 425/7
3,752,611 8/1973 Reed et al. ..... 425/7
4,080,126 3/1978 Clark et al. ..... 425/7
4,124,377 11/1978 Larson ..... 75/0.5 C

*Primary Examiner*—Wayland Stallard
*Attorney, Agent, or Firm*—Wenderoth, Lind & Ponack

[57] ABSTRACT

A method for producing metal powder comprising steps of feeding a molten metal into a closed vessel, atomizing of the metal by inert gas and finally cooling of particles in an atmosphere of inert gas and atomized water is provided.

An apparatus for producing metal powder comprises a closed vessel (1) provided with atomizing nozzles (2) and means for providing inert gas, and another set of nozzles (4) for supply of atomized cooling medium located on one or several vertically displaced levels along the internal perimeter of the vessel (1).

4 Claims, 1 Drawing Sheet

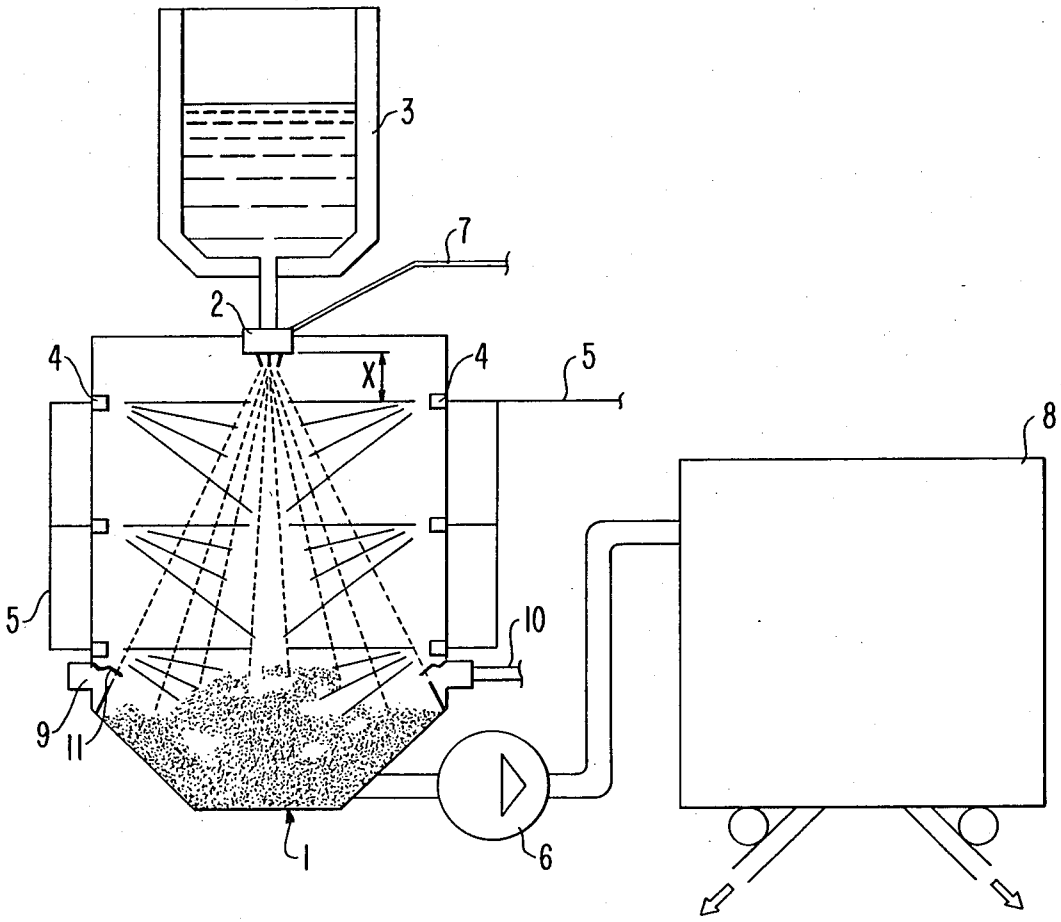
8
5
10
6
7
4
3
X
2
1
4
5
9
11

METHOD AND APPARATUS FOR PRODUCING METAL POWDER

The present invention relates to a method for producing metal powders, and particularly aluminium powder where the molten metal is introduced to a closed vessel or tank and atomized by pressurized inert gas by means of an atomizing nozzle followed by cooling of the atomized molten metal. Furthermore, the invention concerns an apparatus to conduct the method.

Several techniques for producing metal powder are previously known, e.g. reduction of oxide particles by gases, electrolysis of metal salt solutions, decomposition of gaseous metal substances by means of heating and atomization. Each of these techniques covers furthermore several methods and apparatusses for producing metal powder. With regard to the atomization technique, which the present invention relates to, the most known method is the one where the molten metal is atomized by a pressurized fluid by means of an atomizing nozzle.

Air has been used previously in such nozzles as the atomizing fluid and the atomized moten metal was cooled down in an air atmosphere. However, many deficiencies are associated with the prior art devices applying air as the atomizing and cooling medium.

Due to the oxygen content in air the resulting metal powder is oxygen enriched (contaminated), something which results in limited application possibilities for the powder. Furthermore, there is a danger of explosive combination hydrogen/oxygen when atomizing certain reactive alloys, and large space demanding cooling towers were required in order to cool down the atomized molten metal.

Consequently, other atomizing fluids are applied today instead of the air. E.g. U.S. Pat. No. 4,080,126 discloses a method and an apparatus for producing metal powder where water is applied as the atomizing fluid. The apparatus comprises a closed vessel provided with apparatuses for inlet of inert gas and an atomizing nozzle located in an upper region of the vessel for impinging of water stream on vertically descending stream of molten metal. The atomization of the molten metal finds thus place in a non-oxidizing atmosphere and the use of water ensures a rapid cooling of the atomized molten metal due to a direct contact water/molten metal under the atomization process. The resulting metal powder has a low oxygen content and a homogeneous structure thanks to the rapid cooling process.

However, the shape of the achieved powder particles is irregular and suitable for molding by powder metallurgy, but not quite applicable for purposes reguiring fine and uniform particles. A medium diameter of particles provided by this method is in a range from 150 to 175 μm, while particles provided by the method in accordance to the present invention have a diameter in a range from 75 to 100 μm. Furthermore, use of water as an atomizing fluid results in substantially larger variation in particle size and substantially higher content of water in the provided metal powder.

Use of inert gas as atomizing fluid is also known, e.g. from U.S. Pat. No. 4,117,026. The disclosed device for manufacture of spherical metallic powder is in principle essentially the same as disclosed in the above described U.S. Pat. No. 4,080,126, both with regard to the applied apparatus and the mode of operation except for the application of inert gas as the atomizing fluid. Fine particles with uniform size are achieved, but the cooling of the atomized metal in the atmosphere of inert gas gives so low cooling rate that the resulting particles are less homogenous. Furthermore, devices applying inert gas as a cooling medium require also, as mentioned above in connection with cooling conducted in air, large and space demanding cooling towers.

It is therefore an object of the present invention to provide a method for producing metal powders without the above mentioned drawbacks and deficiencies, and particularly metal powder having a fine and homogenous structure, low oxygen content, small and uniform particle size. Another object of the present invention is to provide an improved apparatus having modest space requirement.

In accordance with this invention there is provided a method for producing metal powders where the atomized molten metal is cooled down in an atmoshere of atomized water or a water solution of chlorides and inert gas. An apparatus for producing of metal powders according to the method is also provided, comprising a closed vessel where the metal is atomized and orovided with nozzles supplying atomized water or water solution of Ni and/or Cr-chlorides.

The invention will be described in more details in connection with specific embodiments therof referring to the accompanying drawing, FIG. 1, illustrating schematically an example of set-up of an apparatus according to the present invention.

The apparatus comprises a closed vessel or tank 1. Molten metal is transfered from a reservoir 3 to an atomizing nozzle 2 provided in an upper part of the tank 1 and supplying the tank with atomized metal. The nozzle is advantageously of type USGA (Ultrasonic gas atomization) where the molten metal is atomized by inert gas, e.g. Nitrogen or Argon, but other types of nozzles can also be applied.

The applied atomization pressure is in average of 5 to $50.10^5$ $N/m^2$ or preferably in a range of 15 to $30.10^5 N/m^2$ which results in metal powder particles having a median diameter from 75 to 100 μm.

Inside of the tank there are provided atomizing cooling nozzles 4 supplied with cooling medium water by lines 5. The water atomizing nozzles are located along the perimeter of the tank 1 on several vertically distributed levels. The water atomizing jet is in this manner orientated radially towards the central part of the tank and an advantageous mixing is achieved in the tank.

The water atomizing nozzles, or the nozzles located at the top level of the illustrated configuration of nozzles are intentionally located in a certain distance X from the atomizing nozzle 2 applied on the molten metal. This distance is important in order to achieve a super cooling of the molten particles before their arrival into a solidification zone with the water atomizing jets.

The super cooling of the molten particles results in a special fine and homogenous structure of the metal particles due to the further reduced solidification time. According to the conducted trials a distance X from 20–30 cm gives favourable results in this respect.

The further solidification and cooling of the metal particles during their axial move through the tank occurs by collision with the atomized water particles moving across (in a radial direction) the tank. In this manner the "steamfilm" formed around the metal particles is broken down in an efficient way and a high rate of solidification and cooling is achieved.

The inert gas applied for the atomization of molten metal is normally adequate to maintain the required inert atmosphere in the tank. In order to maintain a required constant pressure slightly above the atmosphere pressure the lower part of the tank 1 is provided with collecting means 9 for the "spent" inert gas, located between the water atomizing nozzles 4 and the level of metal powder or water level. The collecting means (collector) comprising an inwardly recessed skirt 11 extent along the tank pheriphery connected by a pipe 10 to exhausting means (not shown in the figure). The "spent" inert gas contains also water particles and steam. Some of this steam and water particles condenses and deposits in the collector 9 and is drained, e.g. by a pipe and returned to the tank.

The metal powder and the water collected of the bottom of the tank is transferred by means of a pump 6 through pipe conducts 7 to a centrifugal decanter 8 which separates the metal powder from the water phase. The powder containing from 4 to 7% water after decantation is passed over to an indirect heated drying drum in order to reduce the water content to an acceptable level.

In the above described method and apparatus for producing of metal powders according to the present invention water was applied as the cooling medium. It is considered advantageous to apply a water solution containing Nickel and/or Chromium chlorides as the cooling medium in the process of manufacturing Aluminium or Aluminium alloy powders. The particles achieved from conducted trials are covered with a thin layer of Ni and/or Cr-substances. This "coating" has a beneficient effect on control of oxidation and pick-up of humidity.

Co-extrusion of fibre reinforced materials composites can be mentioned as a typical application of Aluminium powder where the Ni/Cr- coating of the particle surface will improve the bounding between fibres, such as SiC, $S_iO_2$, $Al_2O_3$) and the matrix.

Furthermore, metal powders produced by the method and apparatus according to this invention are especially useful and applicable for plasma spraying of articles.

The powder can of course be advantagously applied also for other purposes, e.g. for compacting and following extrusion of articles, for forging and machine work (treatment).

We claim:

1. A method for producing metal powder, said method comprising:

introducing molten metal into a closed vessel;

atomizing said molten metal by an inert gas by means of an atomizing nozzle to thus form metal particles; and cooling said metal particles within said vessel in an atmosphere consisting of inert gas and atomized water.

2. A method as claimed in claim 1, where the produced metal powder is an aluminum or Al-alloy powder, and the cooling atmosphere consists of inert gas and an atomized water solution of nickel chloride or nickel and chromium chlorides.

3. An apparatus for producing metal powder, said apparatus comprising:

a closed vessel;

means for feeding molten metal into said vessel through an atomizing nozzle mounted thereon;

means for supplying inert gas through said nozzle into said vessel and thereby atomizing the molten metal to form metal particles;

atomizing nozzles for supplying atomized cooling medium provided inside of said vessel and located on one or several vertically displaced levels around the perimeter thereof, thereby cooling the metal particles; and an outlet for a pump located at the bottom of said vessel for transfer therefrom of cooling medium and the formed metal particles to separator means.

4. An apparatus as claimed in claim 3, wherein the uppermost said nozzle for atomizing the cooling medium is located a distance of from 20 to 30 cm from said nozzle for atomizing the molten metal.

* * * * *